US006612437B1

(12) United States Patent
Klemets

(10) Patent No.: US 6,612,437 B1
(45) Date of Patent: Sep. 2, 2003

(54) METHOD DISPENSING ABRASIVE MATERIALS, AND AN ABRASIVE MATERIAL

(75) Inventor: Ronny Klemets, Jeppo (FI)

(73) Assignee: Oy KWH Mirka AB (FI)

( * ) Notice: Subject to any disclaimer, the term of this patent is extended or adjusted under 35 U.S.C. 154(b) by 14 days.

(21) Appl. No.: 09/708,970

(22) Filed: Nov. 8, 2000

Related U.S. Application Data

(63) Continuation-in-part of application No. 09/243,573, filed on Feb. 3, 1999, now abandoned.

(30) Foreign Application Priority Data

Feb. 5, 1998 (FI) ..... 980263

(51) Int. Cl.[7] ..... B65D 85/00
(52) U.S. Cl. ..... 206/445; 206/806
(58) Field of Search ..... 206/445, 806, 206/813; 451/533, 538–539, 350, 353, 326

(56) References Cited

U.S. PATENT DOCUMENTS

| | | | | |
|---|---|---|---|---|
| 3,267,623 | A | 8/1966 | Block | |
| 3,285,407 | A | 11/1966 | Abramson | 206/407 |
| 3,987,931 | A | 10/1976 | Fell et al. | |
| 4,294,357 | A | 10/1981 | Stevens et al. | |
| 4,893,438 | A | 1/1990 | Fry et al. | |
| RE33,264 | E | 7/1990 | Baxley et al. | 206/554 |
| 4,947,990 | A | 8/1990 | Klemets | |
| 5,170,595 | A | 12/1992 | Wiand | |
| 5,405,022 | A | 4/1995 | Rissley | |
| 5,730,296 | A | 3/1998 | Limmer | |

FOREIGN PATENT DOCUMENTS

| | | |
|---|---|---|
| DE | 26 26 129 | 12/1977 |
| DE | 29 26 340 | 2/1981 |
| EP | 0 021 348 | 1/1981 |
| EP | 0 721 756 | 7/1996 |
| EP | 3030010 | 10/1996 |
| FI | 63880 | 3/1983 |
| FI | 76762 | 6/1988 |
| FI | 94603 | 3/1990 |
| GB | 2 275 007 | 8/1994 |
| JP | 59-124576 | 7/1984 |
| JP | 63-154446 | 10/1988 |

*Primary Examiner*—Mickey Yu
*Assistant Examiner*—Jila M. Mohandesi
(74) *Attorney, Agent, or Firm*—Altera Law Group LLC

(57) ABSTRACT

The present invention relates to a method of dispensing abrasive materials and to an abrasive material, such as a sheet or disc. An abrasive material means a flexibly bendable abrasive sheet product, one side of which is provided with an abrasive agent with a varying grit size. A plural number of abrasive materials are preferably arranged in a bundle in a dispenser means so that the sides of the abrasive materials provided with an abrasive agent face the same direction. The object of the present invention is to release the abrasive material from the dispenser means in a simpler way, simultaneously preventing any protective coverings on the abrasive material from being detached and spread about the working space. Such tabs are arranged on the back side of the abrasive material, the tabs being interconnected. When the abrasive materials of the invention are removed from the dispenser means, the tabs still remain attached to each other.

12 Claims, 1 Drawing Sheet

METHOD DISPENSING ABRASIVE MATERIALS, AND AN ABRASIVE MATERIAL

This application is a continuation-in-part of application Ser. No. 09/243,573, filed Feb. 3, 1999 now abandoned, incorporated herein by reference in its entirety, which claims priority from Finnish application number 980263, filed Feb. 5, 1998.

BACKGROUND OF THE INVENTION

The present invention relates to a method of dispensing abrasive materials, such as sheets or discs, the abrasive materials being arranged in a bundle so that those sides of the abrasive materials that are provided with an abrasive agent face the same direction.

The invention also relates to an abrasive material dispensed by the above method.

The invention principally concerns a flexibly bendable abrasive sheet product, which hereinafter will be called an abrasive material. The product comprises plates, such as discs or sheets, cut beforehand and coated on one side with an abrasive agent of a varying grit size.

Prior art abrasive materials include, for example, a line of self-adhesive abrasive materials. The abrasive materials are connected to each other along perforated lines, principally tangentially to the periphery of an individual abrasive material. A solution like this is disclosed, for example, in FI 94 603. That side of the continuous abrasive materials which is coated with glue is usually completely covered with a continuous plastic film of a similar shape. This, however, makes it difficult to detach the plastic film from the abrasive material when the material is to be used. Further, the abrasive material must be cut off from large sheets to make it continuous, wherefore a large amount of raw material for abrasive materials is wasted during the production.

To eliminate the above problems, it has been suggested that the abrasive material should be cut off entirely, and the materials should then be attached one after the other to a supporting strip made of paper or to some other elongated means. For example, FI 63 880 teaches solutions where the abrasive material is secured to a supporting strip so that every other abrasive material overlaps every other, and the resultant continuous entity is then rolled up.

From DE 26 26 129 it is also known to arrange the abrasive material on a supporting strip by securing it to the supporting strip along the entire back side.

DE 29 26 340 teaches solutions in which the abrasive materials are fixed to a supporting strip one after the other in a line. The continuous entity is then folded up in a bundle so that every other abrasive material has the side with the abrasive agent facing upward, and every other has the side with the abrasive agent facing downward. A surface provided with an abrasive agent is therefore always facing another surface provided with an abrasive agent in the bundle. To prevent the back sides that are provided with glue and face each other from attaching to each other, the supporting strip must cover the entire back side of the abrasive material provided with glue. Further, each surface provided with glue can be provided with a separate protective covering. If two surfaces provided with glue are allowed to attach to each other, it is extremely difficult to separate them.

The DE publication also discloses an embodiment in which each abrasive material is provided with a protective covering on the back side provided with glue and is connected to a continuous entity by means of separate supporting strips provided with glue. The supporting strip is fixed to the protective coverings of two abrasive materials close to each other. In this embodiment, the abrasive materials are arranged in a bundle so that the front sides provided with an abrasive agent face upward, and each supporting strip is folded in Z form, whereby the free part of the supporting strip principally corresponds to the diameter of the abrasive material in length. This requires a large amount of supporting strip material and a technically advanced feeding line, where the abrasive materials are secured to the supporting strips with acceptable results.

Finally, FI 76 762 teaches solutions in which the abrasive material is fixed to a continuous supporting strip to provide a continuous entity. The entity is then formed into a bundle than can be placed, for example, in a dispenser box. In a solution according to the publication, the abrasive materials in the bundle have the front sides provided with an abrasive agent facing upward, and the supporting strip is passed in loops between the abrasive materials along one side of the bundle. The upper part of each loop of the supporting strip is fixed to the back side of the abrasive material, which is not coated with an abrasive agent, whereas the lower part of each loop of the supporting strip is free between the upper part of the loop and the front side of the abrasive material, provided with an abrasive agent. The supporting strip is thus rendered as short as possible, and yet the supporting materials are efficiently prevented from attaching to each other.

A problem common to all the above solutions is that as the abrasive materials, both sheets and discs, are released from the supporting strip, the supporting strip and the protective coverings are detached and, depending on the implementation, are either left hanging from the dispenser box or are collected on a horizontal surface nearby. Gradually, the supporting strip and the protective coverings form big, disturbing piles or loops in the vicinity of the dispenser box. Such films hanging or lying about are dangerous to health: their surface is slippery, which increases accident risk in the workplace.

The previously known solutions often also require that when the abrasive material is detached from the protective covering, both hands must be used: with one hand one grips the abrasive material and with the other one releases the protective covering.

SUMMARY OF THE INVENTION

The problems of the prior art are mainly avoided with the present invention. The abrasive material is much simpler to remove from the dispenser means or detach from the protective covering, and the protective coverings do here not accumulate in undesired amounts on different surfaces, such as workbenches or the floor.

The above problems are solved by the present invention, which has the characteristics disclosed in the claims. A method of the present invention is thus characterized by what is stated in the characterizing part of claim 1.

Further, an apparatus of the present invention is characterized by what is stated in the characterizing part of claim 4.

Many significant advantages are achieved with the method and apparatus of the present invention as compared with the prior art. For example, it is very simple to fasten a tab of the invention to an abrasive material. No complicated feeding lines are thus needed for exact positioning of the tab in respect of the abrasive material. With a solution of the invention, considerably less material is needed for the supporting strip, and so the packaging costs can be minimized.

A tab according to the present invention makes is very easy to detach the abrasive material by gripping it simply with only one hand. This is very important, since the user usually needs the other hand to operate a grinding machine. Although the method is simple, the working space will not be littered at all.

The abrasive material often comprises some kind of attachment means, such as glue or a Velcro fastener, on the back side. It is thus very simple to attach the tab to and detach it from the abrasive material. To prevent the abrasive materials close to each other from attaching to each other, the attachment means preferably comprise a protective covering. When the protective covering is attached to the tab, the tab is easy to detach together with the protective covering, the protective covering remaining in the dispenser means.

BRIEF DESCRIPTION OF THE DRAWINGS

In the following the invention will be described in greater detail with reference to the drawing, in which.

DESCRIPTION OF THE PREFERRED EMBODIMENTS

Figure 1:
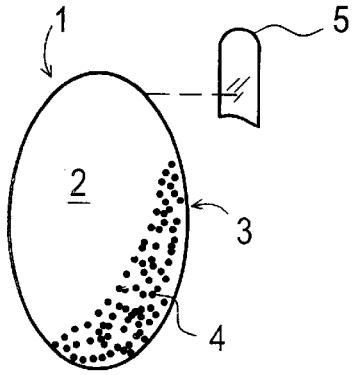
FIG. 1 shows an illustrative view of an abrasive material with a tab before the tab is attached to the back side of the abrasive material.

Referring to FIG. 1 there is shown an abrasive material 1 with a front side 2 and a back side 3. The front side is provided with an abrasive agent 4 whose grit size may vary, here only illustratively and partly shown. The back side of the abrasive material is preferably provided with an attachment means, such as an adhesive (FIG. 1) or a velour coating (FIG. 2), which is arranged to work in co-operation with Velcro fasteners. However, the back side need not comprise any attachment means at all.

Figure 2:
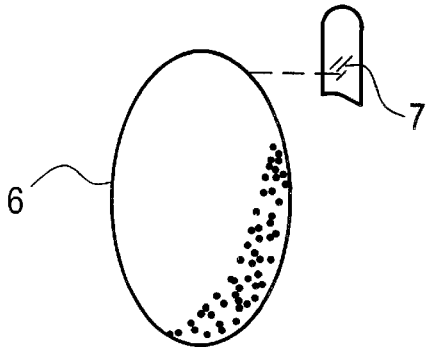
FIG. 2 shows a similar solution as FIG. 1, the abrasive material and the tab being here attached with a Velcro fastener.

In the figures a tab 5 is arranged on the back side 3 of the abrasive material. This tab is arranged on the back side so that at least a part of the tab projects from the outer edge 6 of the abrasive material 1. If there is an adhesive on the back side, the tab is secured to the abrasive material with the adhesive. If there is, for example, a velour coating on the back side as described above, the tab 5 is secured to the back side 3 of the abrasive material 1 with a Velcro fastener 7 known per se, as shown in FIG. 2. If there are no attachment means on the back side, the tab is arranged to be self-adhesive, whereby it is easy to attach to the abrasive material.

Figure 3:
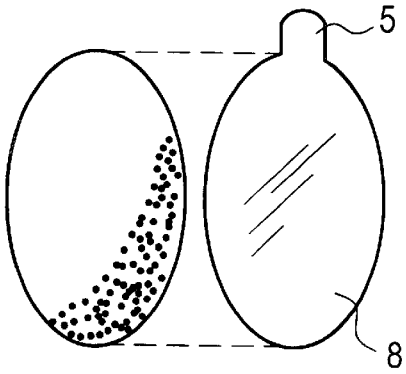
FIG. 3 shows a tab comprising a protective covering, the tab being arranged to cover essentially the entire back side of the abrasive material.

If the back side 3 of the abrasive material 1 is provided with attachment means, such as some kind of adhesive, glue for instance, a protective covering 8 is preferably arranged to cover the back side. The protective covering may cover the back side partly or completely. This way it can be ensured that the discs and sheets of abrasive material cannot attach to each other, especially when the abrasive materials have a small grit size. The protective covering is preferably arranged to the tab 5, so that the covering and the tab can be peeled off from the abrasive material simultaneously by a single movement of the hand. Preferably the tab it self comprises a protective covering as illustrated in FIG. 3. Both the tab and the protective covering are preferably made of paper or a plastic film coated with silicon, which makes it easier to detach the tab from the abrasive material provided with attachment means.

Figure 4:
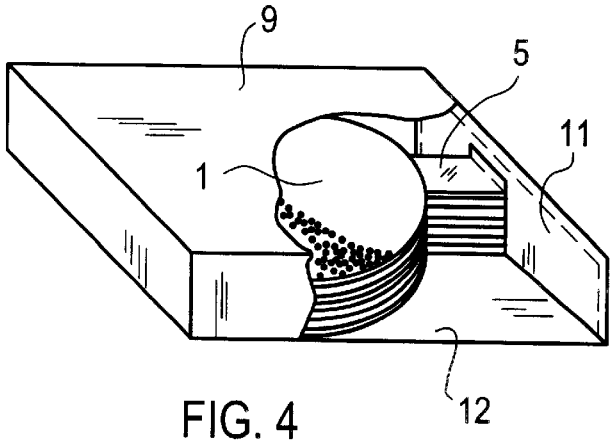
FIG. 4 shows abrasive materials provided with tabs, the tabs being interconnected and attached to a dispenser means which is in form of a case

Referring to FIG. 4 there is shown a number of abrasive materials 1 provided with tabs 5 and being arranged to a dispenser means 9. This particular embodiment of the dispenser means preferably comprises an openable transport case. The abrasive materials are thus packed in the case, the number of abrasive materials packed varying from a few to even dozens of materials according to the users' needs.

According to FIG. 4 the abrasive materials 1 are placed essential on top of each other while the tabs 5 are protruding from the back side 3 at essentially the same location. These tabs are interconnected fixing the abrasive materials to a bundle. The tabs are fixed to each other by mechanical fastening means or by some kind of adhesive 10 for instance. The tabs in this preferred embodiment are fixed together by glue. The bundle formed by interconnecting the tabs of the abrasive materials 1 is fixed to a side wall 11 of the case forming the dispenser means 9. The connection between the bundle and the side wall of the case is preferable made when the tabs are fixed together with the adhesive. This way the same adhesive may be used. It is also sufficient that only the lowermost tab, i.e. the one in contact with the bottom 12 of the dispenser means, is secured onto the surface of the dispenser means also, for example, by gluing.

Figure 5:
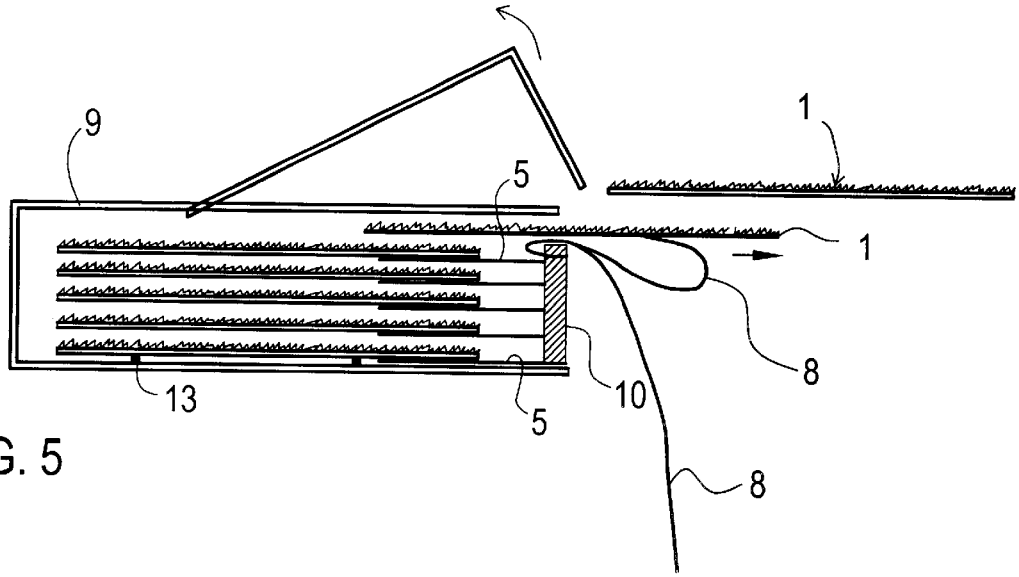
FIG. 5 shows an illustrative sectional view of abrasive materials each with a tab the tabs being attached to the back side of the abrasive material, and interconnected, the bottommost abrasive material further being attached to a dispenser means which is in form of a case

Referring now to FIG. 5 the bundle formed by interconnecting the tabs 5 of the abrasive materials 1 is fixed to the dispenser means 9 by attaching the bottommost abrasive material to the surface of the bottom 12 in the dispenser means. Referring to FIG. 5 the bottommost abrasive material is fixed by adhesive 13 to the bottom of the case.

When the abrasive materials 1 are removed from distribution means 9 according to FIG. 4 or FIG. 5, the tabs 5 and the protective coverings 8, if any, remain attached to the distribution means thus preventing any littering of the working area. The abrasive materials may also be removed using just one hand, since the tabs arranged to the sheets of abrasive material are directly or indirectly fixed to the distribution means.

A dispenser means 9 of this kind containing a bundle of abrasive materials 1 can be arranged in a horizontal position on a workbench or a worktable, so that the abrasive material can be detached from the tab with a simple movement of the hand. The dispenser means can also be provided with a hole or some other means with which it can hang on an essentially vertical surface.

The above description and the accompanying figures are to be understood only as illustrating the present method of dispensing abrasive materials, and an abrasive material used thereby. The method and material is thus not restricted to the embodiments described above or in the attached claims, but it can be varied or modified in many ways without deviating from the idea disclosed in the attached claims.

What is claimed is:

1. A method of dispensing abrasive materials, each abrasive material having a front side and a back side, the front side being provided with an abrasive agent, a plural number of abrasive materials being arranged in a bundle on top of each other, wherein the front sides of the abrasive materials face in the same direction, the method comprising:

arranging detachable tabs on the back sides of each separate abrasive material, wherein each individual tab is arranged to at least partly overlap the back side while the tab simultaneously partly projects from the outer edge of the abrasive material, the parts of each adjacent tab projecting from the back side of each abrasive material being fixed to each other; and forming an essentially undetachable interconnection between all of the tabs.

2. The method of dispensing abrasive materials as claimed in claim 1, wherein while the adjacent tabs are fixed to each other, the interconnected tabs are simultaneously fixed to a common dispenser, the attachment to the dispenser preventing the tab from detaching from the dispenser when any abrasive material in the bundle is dispensed.

3. The method of dispensing abrasive materials as claimed in claim 1, wherein while the adjacent tabs are fixed to each other, the bottommost abrasive material in the bundle is fixed to a common dispenser, the attachment to the dispenser preventing the tab from detaching from the dispenser when any abrasive material in the bundle is dispensed.

4. A dispenser of a plurality of abrasive materials, each abrasive material having a front side and a back side, the front side comprising an abrasive agent, the dispenser comprising:

a plural number of similar abrasive materials, being arranged in a bundle on top of each other with the front sides of the abrasive materials facing in the same direction, wherein the back side of each separate abrasive material comprises:

a detachable tab, each individual tab being arranged to at least partly overlap the back side and simultaneously at least partly project from an outer edge of the abrasive materials, each adjacent tab of the abrasive materials being interconnected.

5. The dispenser according to claim 4, wherein the interconnected tabs are attached to the dispenser, the attachment preventing the tabs from detaching from the dispenser.

6. The dispenser according to claim 5, wherein the tabs are interconnected by using an adhesive material.

7. The dispenser according to claim 6, wherein the tabs are attached to the dispenser by using the adhesive material.

8. The dispenser according to claim 7, wherein the tabs are interconnected and simultaneously secured to the dispenser using the adhesive material.

9. The dispenser according to claim 4, wherein the bottommost abrasive material is attached to the dispenser, the attachment preventing the tabs from detaching from the dispenser.

10. The dispenser according to claim 9, wherein the tabs are interconnected and the bundle thus formed is attached to the dispenser.

11. The dispenser according to claim 10, wherein the bundle is fastened to the dispenser using an adhesive material.

12. The dispenser according to claim 11, wherein the dispenser includes an openable case.

* * * * *